US005606752A

United States Patent [19]

Shenton, Jr. et al.

[11] Patent Number: 5,606,752

[45] Date of Patent: Mar. 4, 1997

[54] SPLASH GUARD APPARATUS FOR SHOWER CURTAINS

[76] Inventors: John M. Shenton, Jr., 910 North Point Rd., Baltimore, Md. 21224; John M. Shenton, III, 2306 Cloverdale Dr., Fallston, Md. 21047

[21] Appl. No.: 599,168

[22] Filed: Feb. 9, 1996

[51] Int. Cl.[6] ..... A47K 3/22

[52] U.S. Cl. ..... 4/609; 4/605; 4/610; 24/509; 160/349.2

[58] Field of Search ..... 4/609, 605, 608, 4/610; 24/500, 501, 509, 508; 160/DIG. 6, 349.1, 349.2, 402, 399

[56] References Cited

U.S. PATENT DOCUMENTS

| | | | |
|---|---|---|---|
| D. 284,027 | 5/1986 | Olson | 4/609 |
| D. 316,028 | 4/1991 | Wallace . | |
| 4,759,087 | 7/1988 | Zeilinger | 4/608 |
| 4,765,001 | 8/1988 | Smith . | |
| 4,771,517 | 9/1988 | Donanno | 4/609 |
| 4,825,481 | 5/1989 | Lonberger . | |
| 4,887,324 | 12/1989 | Caivns | 4/609 |
| 4,944,050 | 7/1990 | Shames et al. . | |
| 5,023,964 | 6/1991 | Unsworth | 160/DIG. 6 |
| 5,070,551 | 12/1991 | Harrison et al. . | |
| 5,274,859 | 1/1994 | Redman et al. . | |

*Primary Examiner*—David J. Walczak

[57] ABSTRACT

A splash guard apparatus for a shower curtain includes a base member, a clamping wall member connected to the base member, a movable connection assembly connected to the base member, and a clamp assembly connected to the movable connection assembly. The clamp assembly includes a connection portion connected to the movable connection assembly and includes a damping portion connected to the connection portion at a juncture portion. The base member has a length and a width, and the length is substantially greater than the width. A quantity of adhesive material may be located on a back side of the base member for connecting the base member to a wall. In one embodiment, a threaded bolt is connected to the base member, and a helical spring is mounted on the threaded bolt. In another embodiment, a hinge assembly is connected between the base member and the clamp assembly. With another embodiment, a first spring retention portion is connected to the base member; a second spring retention portion is connected to the connection portion of the damp assembly; and a helical spring is connected between the first spring retention portion and the second spring retention portion. With another embodiment, a flat spring is connected to the base member and is located between the base member and the connection portion of the clamp assembly. Each spring provides a bias force for clamping the damping portion of the damp assembly against the clamping wall member.

12 Claims, 3 Drawing Sheets

SPLASH GUARD APPARATUS FOR SHOWER CURTAINS

BACKGROUND OF THE INVENTION

1. Field of the Invention

The present invention relates generally to splash guards for shower curtains and, more particularly, to shower curtain splash guards that are mounted on a shower wall.

2. Description of the Prior Art

When a flexible shower curtain is used in a shower, a clearance is often present between a vertical edge of the shower curtain and the wall of the shower enclosure. When a clearance is present at the vertical edge of the shower curtain that is nearest the shower head, there is a strong tendency for water from the shower head to escape through the clearance and fall onto the floor of the shower room. Floors that are wet from this cause are dangerous, or otherwise undesirable, for a number of reasons. A person exiting from a shower and placing one's feet on a wet floor often has a susceptibility to slipping and falling. In addition, water on a wet floor can cause the floor to deteriorate. Moreover, water on a wet floor can seep through the floor and cause a ceiling below the shower room to be stained or even leak. Therefore, it desirable if a means were devised to prevent water from a shower from wetting the floor in the shower room.

Throughout the years, a number of innovations have been developed relating to devices for preventing water from a shower from wetting the floor in a shower room, and the following U.S. patents are representative of some of those innovations: U.S. Pat. Nos. 4,765,001, 4,825,481, 4,944,050, 5,070,551, 5,274,859, and U.S. Des. Pat. No. 316,028. More specifically, U.S. Pat. No. 4,765,001 discloses a splash guard for bathtub showers which employs a first plastic strip attached to a wall of a shower enclosure and a second plastic strip attached to the top of a bathtub. It is noted that some showers are provided in houses and other facilities in which no bathtub is present. In this respect, it would be desirable if a splash guard for a shower curtain were provided which does not require the presence of a bathtub.

U.S. Pat. No. 4,825,481 discloses a shower curtain fastening arrangement which employs a plurality of separate and distinct individual clamps to be arranged along the wall of a shower enclosure to clamp onto portions of an edge of a shower curtain. A problem with employing separate and distinct individual clamps arises from the fact that portions of a vertical edge of a shower curtain that are not clamped can bunch up and form gaps between the shower curtain edge and the wall of the enclosure. Water can emerge from those gaps and fall on the floor of the shower room. In this respect, it would be desirable if a splash guard for a shower curtain were provided which prevents gaps from forming between the vertical edge of a shower curtain and the wall of the shower enclosure.

Each of U.S. Pat. Nos. 4,944,050 and 5,274,859 discloses a two-dimensional splash panel that fits into a corner between a wall of a shower enclosure and a top of a bathtub. As mentioned herein above, it would be desirable if a splash guard device for shower curtains could be used in the absence of a bathtub. Moreover, a two-dimensional panel that is located between a wall of a shower enclosure and a top of a bathtub can provide an obstacle that impedes a person from exiting from the shower enclosure when the shower has been completed. In this respect, it would be desirable if a splash guard for a shower curtain were provided which does not provide an obstacle that impedes a person from exiting from a shower enclosure after a shower has been completed.

Each of U.S. Pat. No. 5,070,551 and U.S. Des. Pat. No. 316,028 discloses a shower curtain fastening arrangement which employs a plurality of separate and distinct individual damps to be arranged along the wall of a shower enclosure to clamp onto portions of an edge of a shower curtain. A problem with employing separate and distinct individual clamps has been discussed hereinabove in relation to U.S. Pat. No. 4,825,481, and such problems are also present with U.S. Pat. Nos. 5,070,551 and Des. 316,028.

Still other features would be desirable in a splash guard apparatus for shower curtains. For example, it would be desirable if a splash guard for shower curtains included a spring-biased clamp to provide a secure shower-curtain clamping action. In operating the spring-biased clamp, it would be desirable if a single counterforce can be exerted on the spring-biased clamp to permit entry and exit of a substantial edge portion of a vertical edge of a shower curtain. Moreover, for a spring-biased clamp, it would be desirable if the bias strength of the spring can be adjusted.

Thus, while the foregoing body of prior art indicates it to be well known to use splash guards for shower curtains, the prior art described above does not teach or suggest a splash guard apparatus for shower curtains which has the following combination of desirable features: (1) prevents water from a shower from wetting the floor in the shower room; (2) does not require the presence of a bathtub in order to operate properly; (3) prevents gaps from forming between a vertical edge of a shower curtain and a wall of the shower enclosure; (4) does not provide an obstacle that impedes a person from exiting from a shower enclosure after a shower has been completed; (5) includes a spring-biased clamp to provide a secure shower-curtain clamping action; (6) permits a single counterforce to be exerted on a spring-biased clamp to permit entry and exit of a substantial portion of a vertical edge of a shower curtain; and (7) permits bias strength of a spring-biased clamp to be adjusted. The foregoing desired characteristics are provided by the unique splash guard apparatus for shower curtains of the present invention as will be made apparent from the following description thereof. Other advantages of the present invention over the prior art also will be rendered evident.

SUMMARY OF THE INVENTION

To achieve the foregoing and other advantages, the present invention, briefly described, provides a splash guard apparatus for a shower curtain which includes a base member, a clamping wall member connected to the base member, a movable connection assembly connected to the base member, and a clamp assembly connected to the movable connection assembly. The clamp assembly includes a connection portion which is connected to the movable connection assembly and includes a clamping portion which is connected to the connection portion at a juncture portion. The base member has a length and a width, and the length is substantially greater than the width.

The clamping wall member is substantially coextensive with the base member, and the clamp assembly is substantially coextensive with both the base member and the clamping wall member. The clamping wail member projects at a right angle from the base member. The clamping portion of the clamp assembly is oriented to the connection portion at an orientation angle which is an acute angle. A quantity of adhesive material may be located on a back side of the base member.

The movable connection assembly may include a threaded bolt connected to the base member and a helical spring mounted on the threaded bolt. A portion of the threaded bolt passes through a receiving channel in the connection portion of the clamp assembly. The helical spring is retained on the threaded bolt between the connection portion and the base member. A threaded nut is connected to the threaded bolt between an end portion of the threaded bolt and the connection portion of the clamp assembly.

A movable connection assembly may include a hinge assembly that is connected between the base member and the clamp assembly. More specifically, the hinge assembly is connected between the juncture portion of the clamp assembly and the base member. The hinge assembly includes a hinge bracket that is connected to the base member. A pin-receiving channel is located in the juncture portion of the clamp assembly, and a hinge pin is connected between the hinge bracket and the pin-receiving channel.

In accordance with another aspect of the invention, a first spring retention portion may be connected to the base member. A second spring retention portion is connected to the connection portion of the clamp assembly, and a helical spring is connected between the first spring retention portion and the second spring retention portion. The helical spring provides a bias force for clamping the clamping portion of the clamp assembly against the clamping wall member.

In accordance with another aspect of the invention, a flat spring is connected to the base member and is located between the base member and the connection portion of the clamp assembly. The flat spring includes a base-attaching portion, an intermediate portion extending from the base-attaching portion, and a clamp-assembly-contacting portion extending from the intermediate portion. The flat spring provides a bias force for clamping the clamping portion of the clamp assembly against the clamping wall member.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved splash guard apparatus for shower curtains which has all of the advantages of the prior art and none of the disadvantages.

It is another object of the present invention to provide a new and improved splash guard apparatus for shower curtains which may be easily and efficiently manufactured and marketed.

It is a further object of the present invention to provide a new and improved splash guard apparatus for shower curtains which is of durable and reliable construction.

An even further object of the present invention is to provide a new and improved splash guard apparatus for shower curtains which is susceptible of a low cost of manufacture with regard to both materials and labor, and which accordingly is then susceptible of low prices of sale to the consuming public, thereby making such splash guard apparatus for shower curtains available to the buying public.

Still yet a further object of the present invention is to provide a new and improved splash guard apparatus for shower curtains which prevents water from a shower from wetting the floor in the shower room.

Still another object of the present invention is to provide a new and improved splash guard apparatus for shower curtains that does not require the presence of a bathtub in order to operate properly.

Yet another object of the present invention is to provide a new and improved splash guard apparatus for shower curtains which prevents gaps from forming between a vertical edge of a shower curtain and a wall of the shower enclosure.

Even another object of the present invention is to provide a new and improved splash guard apparatus for shower curtains that does not provide an obstacle that impedes a person from exiting from a shower enclosure after a shower has been completed.

Still a further object of the present invention is to provide a new and improved splash guard apparatus for shower curtains which includes a spring-biased clamp to provide a secure shower-curtain clamping action.

Yet another object of the present invention is to provide a new and improved splash guard apparatus for shower curtains that permits aingle counterforce to be exerted on a spring-biased clamp to permit entry and exit of a substantial portion of a vertical edge of a shower curtain.

Still another object of the present invention is to provide a new and improved splash guard apparatus for shower curtains which permits bias strength of a spring-biased clamp to be adjusted.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 2:
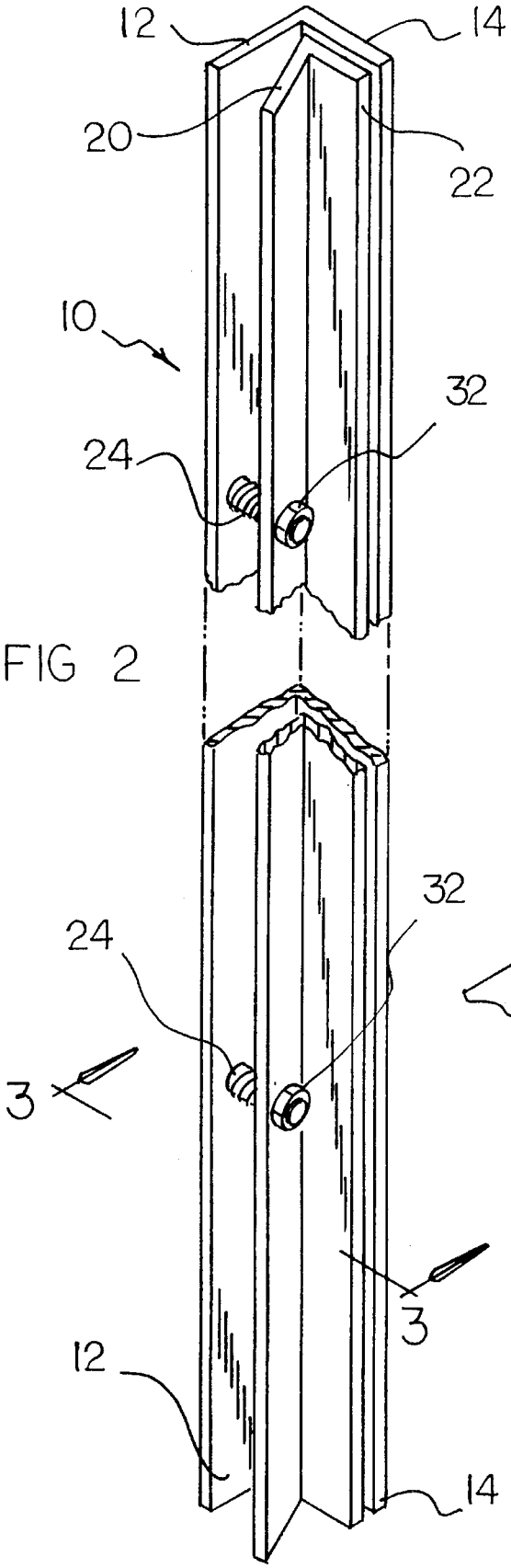
FIG. 2 is an enlarged perspective view of the embodiment of the invention shown in FIG. 1 with the shower curtain removed.
Figure 1:
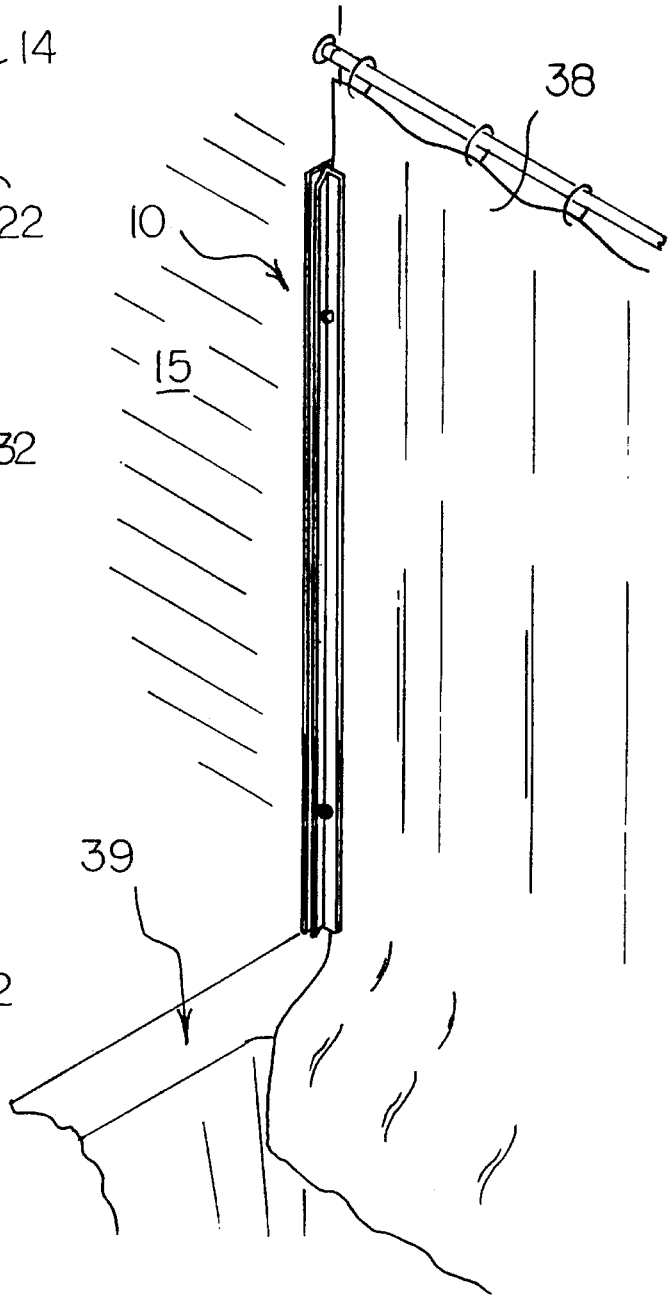
FIG. 1 is a perspective view showing a first embodiment of the splash guard apparatus for shower curtains of the invention in use with a shower curtain, wherein helical springs with adjustable bias are provided.
Figure 3:
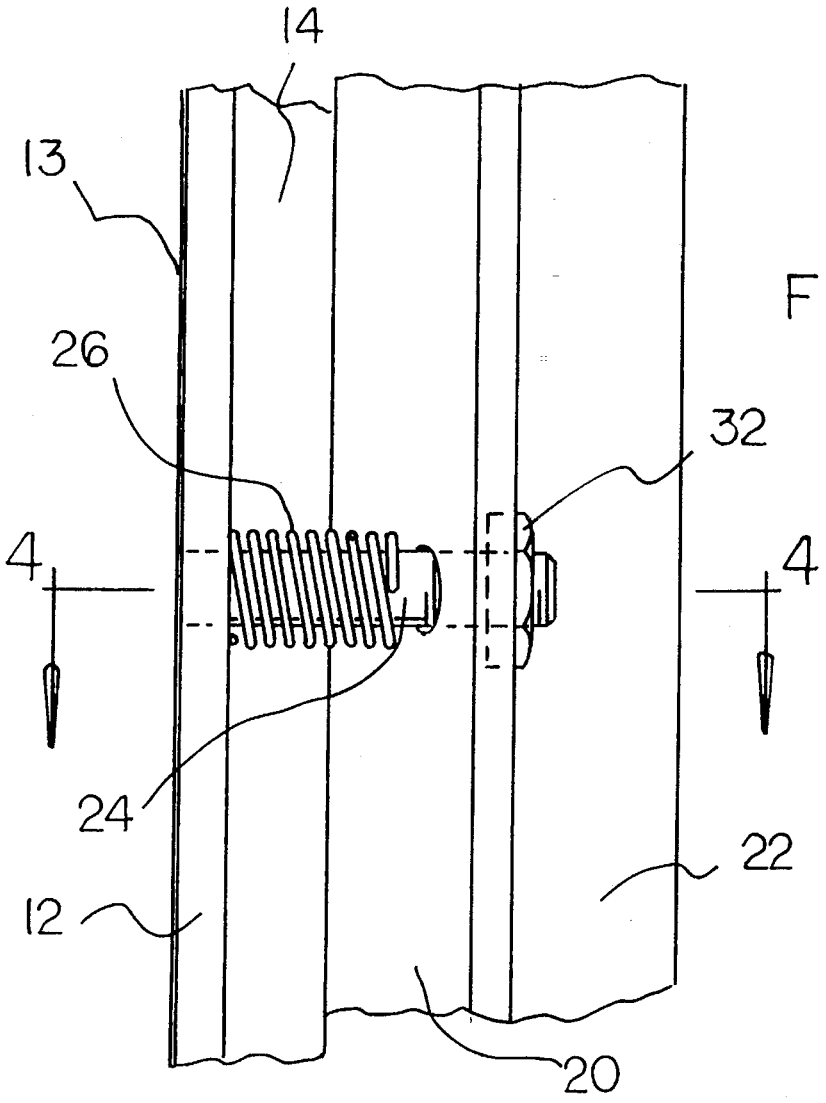
FIG. 3 is an enlarged side view or a portion of the embodiment of the invention shown in FIG. 2 taken along line 3—3 thereof.
Figure 4:
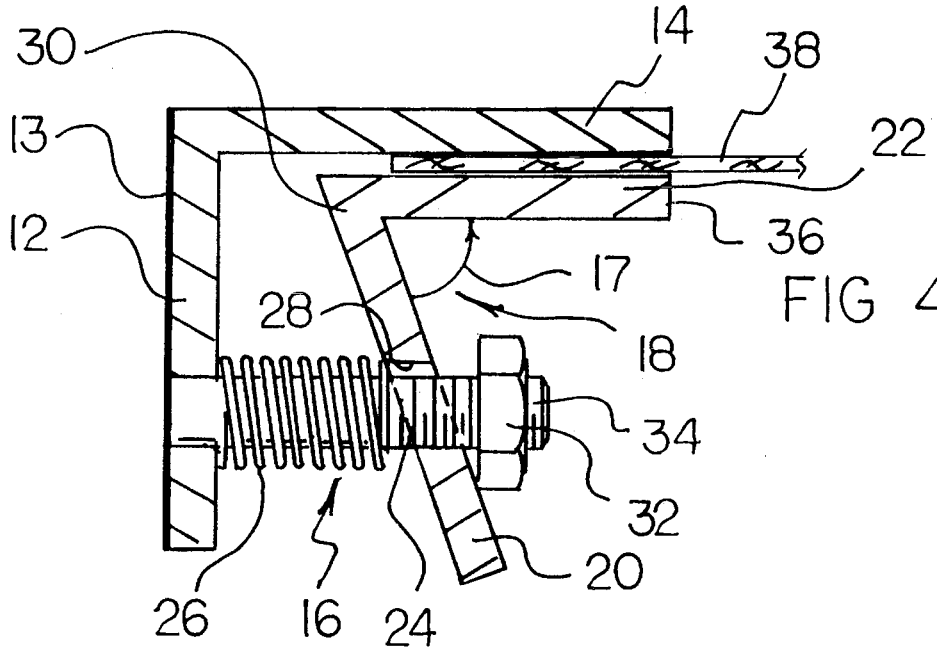
FIG. 4 is a cross-sectional view of the embodiment of the invention shown in FIG. 3 taken along line 4—4 thereof, also including a portion of a shower curtain.

With reference to the drawings, a new and improved splash guard apparatus for shower curtains embodying the principles and concepts of the present invention will be described.

Referring to the first embodiment of the invention shown in FIGS. 1–4, a splash guard apparatus 10 for a shower curtain includes a base member 12, a clamping wall member 14 connected to the base member 12, a movable connection assembly 16 connected to the base member 12, and a clamp assembly 18 connected to the movable connection assembly 16. The clamp assembly 18 includes a connection portion 20 which is connected to the movable connection assembly 16 and includes a clamping portion 22 which is connected to the connection portion 20 at a juncture portion 30. The connection portion 20 of the clamp assembly 18 forms a handle with respect to the clamping portion 22. The longer the handle portion, the greater the leverage that can be used to multiply force that is applied to the connection portion 20 to operate the clamping portion 22. The base member 12 has a length and a width, and the length is substantially greater than the width.

The clamping wall member 14 is substantially coextensive with the base member 12, and the clamp assembly 18 is substantially coextensive with both the base member 12 and the clamping wail member 14. The clamping wall member 14 projects at a right angle from the base member 12. The clamping portion 22 of the clamp assembly 18 is oriented to the connection portion 20 at an orientation angle 17 which is an acute angle. A quantity of adhesive material 13 may be located on a back side of the base member 12. The adhesive material 13 is used to secure the splash guard apparatus 10 to a wall 15 of a shower enclosure.

The movable connection assembly 16 includes a threaded bolt 24 connected to the base member 12 and a helical spring 26 mounted on the threaded bolt 24. A portion of the threaded bolt 24 passes through a receiving channel 28 in the connection portion 20 of the clamp assembly 18. The helical spring 26 is retained on the threaded bolt 24 between the connection portion 20 and the base member 12. A threaded nut 32 is connected to the threaded bolt 24 between an end portion 34 of the threaded bolt 24 and the connection portion 20 of the clamp assembly 18. A plurality of movable connection assemblies 16 can be employed to connect the base member 12 to clamp assembly 18.

In using the first embodiment of the invention, the base member 12 is first installed on a wall 15 of a shower enclosure using the adhesive material 13. Alternatively, screws, nails, or other suitable fasteners can be used to secure the base member 12 to the wall 15. The base member 12 can extend from near the top of the shower curtain 38 to a top of a bathtub 39. It is noted, however, that a bathtub 39 need not be present. To use the clamp assembly 18, an edge portion of the connection portion 20 of the clamp assembly 18 is pushed towards the base member 12. When this occurs, the connection portion 20 of the clamp assembly 18 pushes against the bias force of the helical spring 26 causing the helical spring 26 to compress. Also, when the Connection portion 20 is pushed towards the base member 12, the juncture portion 30 of the clamp assembly 18 moves into contact with the clamping wall member 14 and pivots on the clamping wall member 14. This pivoting action causes the outside edge 36 of the clamping portion 22 of the clamp assembly 18 to move away from the clamping wall member 14 leaving a gap. When this occurs, an edge of a shower curtain 38 is placed in the gap. Then, the connection portion 20 of the clamp assembly 18 is released and the bias force of the helical spring 26 pushes against the connection portion 20 which causes the clamping portion 22 of the clamp assembly 18 to close the gap and clamp the portion of the shower curtain 38 between the clamping portion 22 and the clamping wall member 14. To remove the shower curtain 38 from the splash guard apparatus 10 of the invention, the connection portion 20 is pushed again towards the base member 12 causing the clamping portion 22 of the clamp assembly 18 to separate from the clamping wall member 14. Then, the shower curtain 38 can be removed from the splash guard apparatus 10.

The nut 32 on the threaded bolt 24 can be used to adjust the spring bias force exerted by the helical spring 26. When the nut 32 is turned so that is moves away from the helical spring 26, more of the bias force of the helical spring 26 is transmitted through the connection portion 20 and to the clamping portion 22 of the clamp assembly 18. As a result, the clamping portion 22 exerts a larger clamping force on the shower curtain 38. Conversely, when the nut 32 is turned so that it moves towards the helical spring 26, the helical spring 26 is compressed more so that less bias force is transmitted to the clamping portion 22 of the clamp assembly 18.

Figure 5:
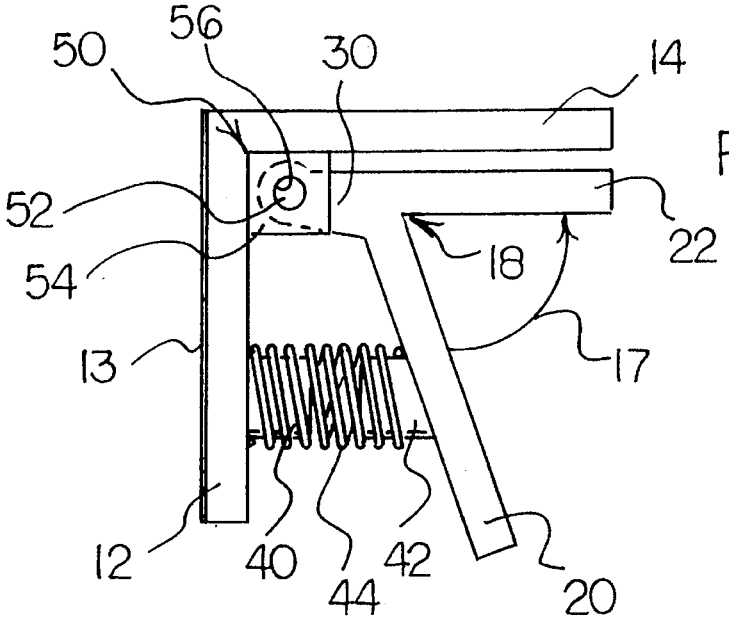
FIG. 5 is a top view of a second embodiment of the invention wherein helical springs, not including bias adjustment, are provided.

Turning to FIG. 5, a second embodiment of the invention is shown. Reference numerals are shown that correspond to like reference numerals that designate like elements shown in the other figures. In addition, the movable connection assembly 16 includes a hinge assembly 50 that is connected between the base member 12 and the clamp assembly 18. More specifically, the hinge assembly 50 is connected between the juncture portion 30 of the clamp assembly 18 and the base member 12. The hinge assembly 50 includes a hinge bracket 54 that is connected to the base member 12. A pin-receiving channel 56 is located in the juncture portion 30 of the clamp assembly 18, and a hinge pin 52 is connected between the hinge bracket 54 and the pin-receiving channel 56.

A first spring retention portion 40 is connected to the base member 12. A second spring retention portion 42 is connected to the connection portion 20 of the clamp assembly 18, and a helical spring 44 is connected between the first spring retention portion 40 and the second spring retention portion 42.

Figure 6:
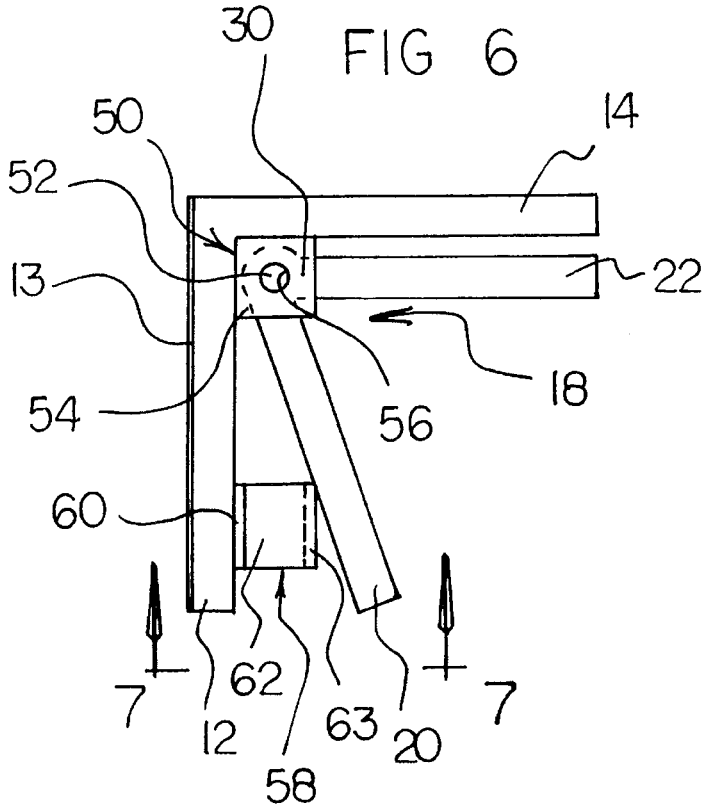
FIG. 6 is a top view of a third embodiment of the invention wherein a flat spring is provided.
Figure 7:
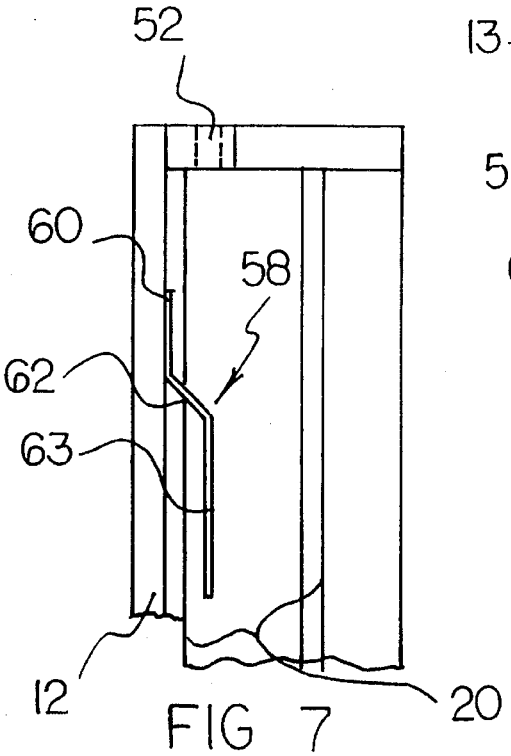
FIG. 7 is a partial front view of the embodiment of the invention shown in FIG. 6 taken along line 7—7 thereof.

Turning to FIGS. 6 and 7, a third embodiment of the invention is shown. Reference numerals are shown that correspond to like reference numerals that designate like elements shown in the other figures. In addition, a flat spring 58 is connected to the base member 12 and is located between the base member 12 and the connection portion 20 of the clamp assembly 18. The flat spring 58 includes a base-attaching portion 60, an intermediate portion 62 extending from the base-attaching portion 60, and a clamp-assembly-contacting portion 63 extending from the intermediate portion 62.

In using the second and the third embodiments of the invention, the connection portion 20 of the clamp assembly 18 is grasped, and the clamping portion 22 of the clamp assembly 18 is moved away from the clamping wall member 14 around the hinge assembly 50. For the second embodiment of the invention, shown in FIG. 5, the bias force of the helical spring 44 is countered during this motion. For the third embodiment of the invention, shown in FIGS. 6 and 7, the bias force of the flat spring 58 is countered during this motion. Once the shower curtain 38 is placed between the clamping wall member 14 and the clamping portion 22 of the clamp assembly 18, the connection portion 20 of the clamp assembly 18 is released, and the clamping portion 22 clamps the shower curtain 38 as a consequence of the bias force exerted by the helical spring 44 for the second embodiment of the invention or exerted by the flat spring 58 for the third embodiment of the invention.

The components of the splash guard apparatus for shower curtains of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved splash guard apparatus for shower curtains that is low in cost, relatively simple in design and operation, and which may advantageously be used to prevent water from a shower from wetting the floor in the shower room. With the invention, a splash guard apparatus for shower curtains is provided which does not require the presence of a bathtub in order to operate properly. With the invention, a splash guard apparatus for shower curtains is provided which prevents gaps from forming between a vertical edge of a shower curtain and a wall of the shower enclosure. With the invention, a splash guard apparatus for shower curtains is provided which does not provide an obstacle that impedes a person from exiting from a shower enclosure after a shower has been completed. With the invention, a splash guard apparatus for shower curtains is provided which includes a spring-biased clamp to provide a secure shower-curtain clamping action. With the invention, a splash guard apparatus for shower curtains is provided which permits a single counterforce to be exerted on a spring-biased clamp to permit entry and exit of a substantial portion of a vertical edge of a shower curtain. With the invention, a splash guard apparatus for shower curtains is provided which permits bias strength of a spring-biased clamp to be adjusted.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A splash guard apparatus for a shower curtain, comprising:

a base member, a clamping wall member connected to said base member, a movable connection assembly connected to said base member, and a clamp assembly connected to said movable connection assembly, said clamp assembly adapted to engage at least a portion of said shower curtain inserted between said clamp assembly and said base member, wherein said clamp assembly includes a connection portion connected to said movable connection assembly and a clamping portion connected to said connection portion at a juncture portion, wherein said movable connection assembly includes:

a threaded bolt connected to said base member, and a helical spring mounted on said threaded bolt, wherein a portion of said threaded bolt passes a receiving channel in said connection portion of said clamp assembly, and wherein said helical spring is retained on said threaded bolt between said connection portion and said base member.

2. The apparatus of claim 1 wherein said base member has a length and a width, wherein said length is substantially greater than said width.

3. The apparatus of claim 1 wherein said clamping wall member is substantially coextensive with said base member.

4. The apparatus of claim 1 wherein said clamp assembly is substantially coextensive with said base member and said clamping wall member.

5. The apparatus of claim 1 wherein said clamping wall member projects at a right angle from said base member.

6. The apparatus of claim 1 wherein said clamping portion of said clamp assembly is oriented to said connection portion at an orientation angle which is an acute angle.

7. The apparatus of claim 1, further including:

a quantity of adhesive material located on a back side of said base member.

8. The apparatus of claim 1, further including:

a threaded nut connected to said threaded bolt between an end portion of said threaded bolt and said connection portion of said clamp assembly.

9. A splash guard apparatus for a shower curtain, comprising:

a base member, a clamping wall member connected to said base member, a movable connection assembly connected to said base member, and a clamp assembly connected to said movable connection assembly, said clamp assembly adapted to engage at least a portion of said shower curtain inserted between said clamp assembly and said clamping wall member, wherein said clamp assembly includes a connection portion connected to said movable connection assembly and a clamping portion connected to said connection portion, said clamping portion being adapted to engage said clamping wall member, wherein said movable connection assembly includes:

resilient biasing means directly connected to a portion of said base member and being operatively coupled to said connection portion of said clamping assembly whereby said clamping portion of said clamping assembly is urged to engage said clamping wall base member by said resilient biasing means.

10. The apparatus of claim 9 wherein said base member and said clamping wall member are angularly oriented with respect to each other.

11. The apparatus of claim 10 wherein said connection portion of said clamping assembly and said clamping portion of said clamping assembly are angularly oriented with respect to each other.

12. The apparatus of claim 11 wherein said angular orientation between said base member and said clamping wall member is a right angle, and the angular orientation between said connection portion of said clamping assembly and said clamping portion of said clamping assembly is an acute angle.

* * * * *